US008992240B2

(12) United States Patent
Shiga

(10) Patent No.: US 8,992,240 B2
(45) Date of Patent: Mar. 31, 2015

(54) CONNECTOR

(71) Applicant: Tyco Electronics Japan G.K., Kanagawa-ken (JP)

(72) Inventor: Katsumi Shiga, Chiba (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 6 days.

(21) Appl. No.: 13/938,783

(22) Filed: Jul. 10, 2013

(65) Prior Publication Data

US 2014/0017925 A1 Jan. 16, 2014

(30) Foreign Application Priority Data

Jul. 10, 2012 (JP) ..... 2012-154226

(51) Int. Cl.
*H01R 13/62* (2006.01)
*H01R 13/629* (2006.01)

(52) U.S. Cl.
CPC ..... *H01R 13/62* (2013.01); *H01R 13/62911* (2013.01)
USPC ..... 439/157

(58) Field of Classification Search
USPC ..... 439/347, 157, 310, 152, 160
See application file for complete search history.

(56) References Cited

U.S. PATENT DOCUMENTS 5,823,807 A * 10/1998 Yamasaki et al. ..... 439/157
5,876,226 A * 3/1999 Tsukakoshi et al. ..... 439/157
5,888,080 A * 3/1999 Maejima ..... 439/157
6,036,509 A * 3/2000 Maejima ..... 439/157
6,045,375 A * 4/2000 Aoki et al. ..... 439/157
6,183,279 B1 * 2/2001 Murakami et al. ..... 439/157
6,244,880 B1 * 6/2001 Fukase et al. ..... 439/157
6,254,407 B1 * 7/2001 Burns ..... 439/157
6,666,697 B2 * 12/2003 Yamashita ..... 439/157
6,733,314 B2 * 5/2004 Konda ..... 439/157
6,773,279 B2 * 8/2004 Yamashita ..... 439/157
6,890,194 B2 * 5/2005 Katsuma ..... 439/157
7,097,476 B2 * 8/2006 Morikawa et al. ..... 439/157
7,179,102 B2 * 2/2007 Yamashita ..... 439/157
7,329,138 B2 * 2/2008 Van Der Mee et al. ..... 439/347
7,419,392 B2 * 9/2008 Tsuji ..... 439/157
7,431,596 B2 * 10/2008 Fukatsu et al. ..... 439/157
7,513,784 B2 * 4/2009 Shibata ..... 439/157
7,568,923 B2 * 8/2009 Fukatsu et al. ..... 439/154
7,918,675 B2 * 4/2011 Van Den Meersschaut et al. ..... 439/157
7,938,655 B2 * 5/2011 Komiyama et al. ..... 439/157
8,235,742 B2 * 8/2012 Komiyama et al. ..... 439/347
8,241,052 B2 * 8/2012 Mulot et al. ..... 439/299
8,297,992 B2 * 10/2012 Park ..... 439/157
8,840,409 B2 * 9/2014 Ikeda et al. ..... 439/157
2004/0121640 A1 * 6/2004 Okamoto et al. ..... 439/347
2007/0207646 A1 * 9/2007 Tsuji ..... 439/157
2014/0017925 A1 * 1/2014 Shiga ..... 439/347

FOREIGN PATENT DOCUMENTS

JP 2008305607 12/2008

* cited by examiner

*Primary Examiner* — Alexander Gilman
(74) *Attorney, Agent, or Firm* — Barley Snyder

(57) ABSTRACT

A connector having a housing with mating face. A slide assembly has a cam pin receiving opening on the mating face with a width W1 measured along the mating face. A slide has cam grooves in communication with the cam pin receiving opening. A cam pin on a mating housing is engageable with the cam pin receiving opening, having a width W2 measured along the mating face being less than the width W1, and a width W3 measured at an angle to the mating face being greater than the width W1.

14 Claims, 10 Drawing Sheets

CONNECTOR

CROSS-REFERENCE TO RELATED APPLICATIONS

This application claims the benefit of the filing date under 35 U.S.C. §119(a)-(d) of Japanese Patent Application No. 2012-154226 filed Jul. 10, 2012.

FIELD OF THE INVENTION

The invention relates to an electrical connector having cam pins that are inserted into cam grooves formed in a slide.

BACKGROUND

Sliding connectors offer the advantage of allowing multi-pole connectors to be engageable by a small force. In a sliding connector, a slide is provided on a housing of one connector to be engaged, and cam pins, which are inserted into cam grooves in the slide, are formed on a housing of a second connector. When the slide is inserted from a starting point and urged to an ending point, both of the connectors engage with each other in a camming motion by the interaction of the cam grooves with the cam pins.

For a general connector, if one connector is inserted at oblique angle relative to an axial mating direction (M), the housing of the one connector can stub the contacts of the second, and may bend the contacts upon mating. To prevent damage to the contacts, guide ribs extending along the mating direction on the housings of both the connectors have been used to guide the mating of the connectors.

For the guide ribs to be effective, the corresponding guide ribs must be formed on both connectors to be mated. Therefore, while the guide ribs can effectively prevent contact damage, this approach is not universal and is limited to connectors already having the guide ribs.

Additionally, the distance between the guide ribs can be relatively large, even if the connector somewhat tilts during initial engagement of one of the guide ribs prior to engaging a second guide rib, the guide ribs work in a concerted effort with each other to start guiding and correcting the connector posture during the time when the end portion of the housing arrives at the ends of contacts, preventing damage to the contacts. However, if the first guide rib extending to the front beyond the ends of contacts is too short in length, the inserted connector can damage the contacts before additional guide ribs are engaged and proper alignment is achieved. On the other hand, if the length of guide rib is too long in length, the connector becomes undesirably large in size.

Additionally, a pair of guiding protrusions have been used to prevent contact damage. These guiding protrusions project from a front surface beyond a lock part of a lock arm that locks two corresponding connectors to each other in an engaged state (see Japanese Patent Publication No. 2008-305607). If an attempt is made to engage one of the corresponding connectors in a tilted posture, an end portion of the guiding protrusion interferes with a lock receiving portion of the corresponding second connector, preventing the engagement of the two corresponding connectors. The lock receiving portion must be guided between the pair of protrusions at the correct angle, thereby preventing damage to the contacts.

The disadvantage of the guiding protrusions disclosed by Japanese Patent Publication No. 2008-305607 is the same as described for the guiding portions, namely that the effectiveness is not universal, and is limited to designs whereby both corresponding connectors already incorporate the guiding protrusions. Accordingly, an object of the present invention is to provide a sliding connector capable of preventing contact damage without forming a guide rib.

SUMMARY

A connector having a housing with mating face. A slide assembly has a cam pin receiving opening on the mating face with a width W1 measured along the mating face. A slide has cam grooves in communication with the cam pin receiving opening. A cam pin on a mating housing is engageable with the cam pin receiving opening, having a width W2 measured along the mating face being less than the width W1, and a width W3 measured at an angle to the mating face being greater than the width W1.

BRIEF DESCRIPTION OF THE DRAWINGS

The invention will now be described by way of example with reference to the accompanying figures of which:

FIG. 4A is a sectional view taken along the line IVa-IVa of FIG. 2B, and FIG. 4B is a sectional view taken along the line IVb-IVb of FIG. 2B;

FIG. 6A is a sectional view taken along the line IVa-IVa of FIG. 2B, and FIG. 6B is a sectional view taken along the line IVb-IVb of FIG. 2B;

FIG. 7A is a sectional view taken along the line IVa-IVa of FIG. 2B, and FIG. 7B is a sectional view taken along the line IVb-IVb of FIG. 2B;

DETAILED DESCRIPTION

The invention will now be described in detail based on an embodiment shown in the accompanying drawings.

Figure 1:
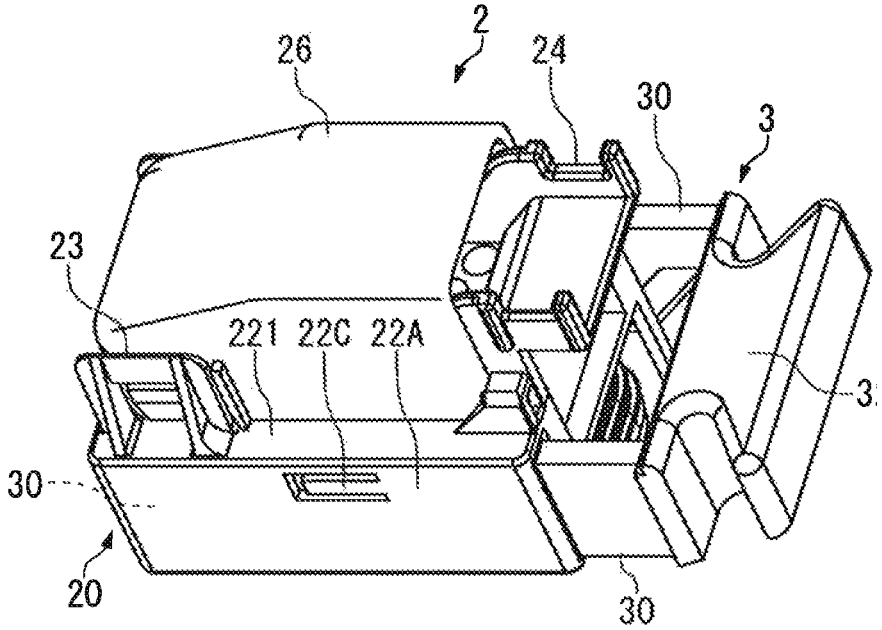
FIG. 1 is an exploded perspective view of a sliding connector showing a state in which a male connector and a female connector are separated from each other.
Figure 1:
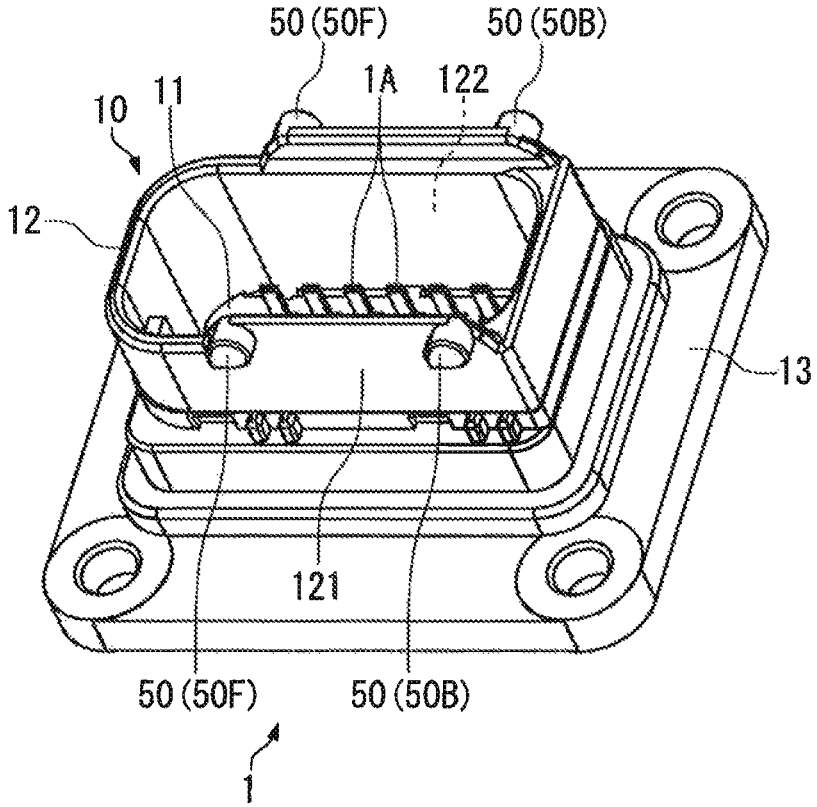
Figure 2B:
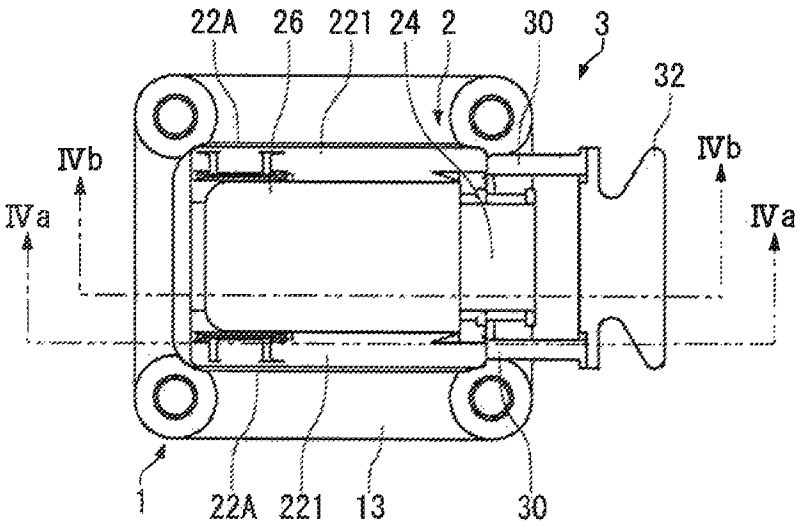
FIG. 2B is a plan view of the sliding connector, showing a state in which a slide is pulled out.
Figure 2A:
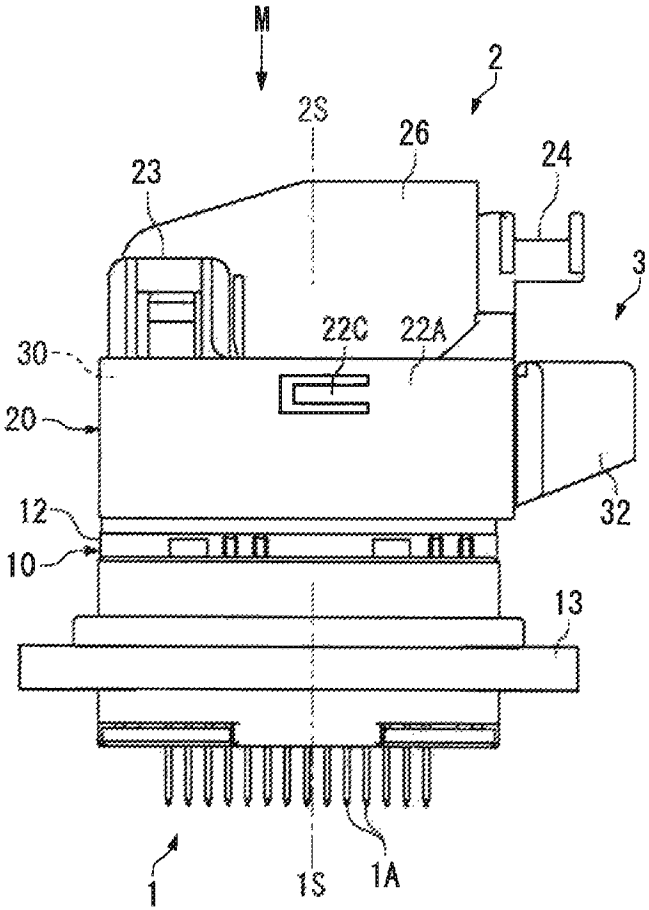
FIG. 2A is a side view of a sliding connector.
Figure 3:
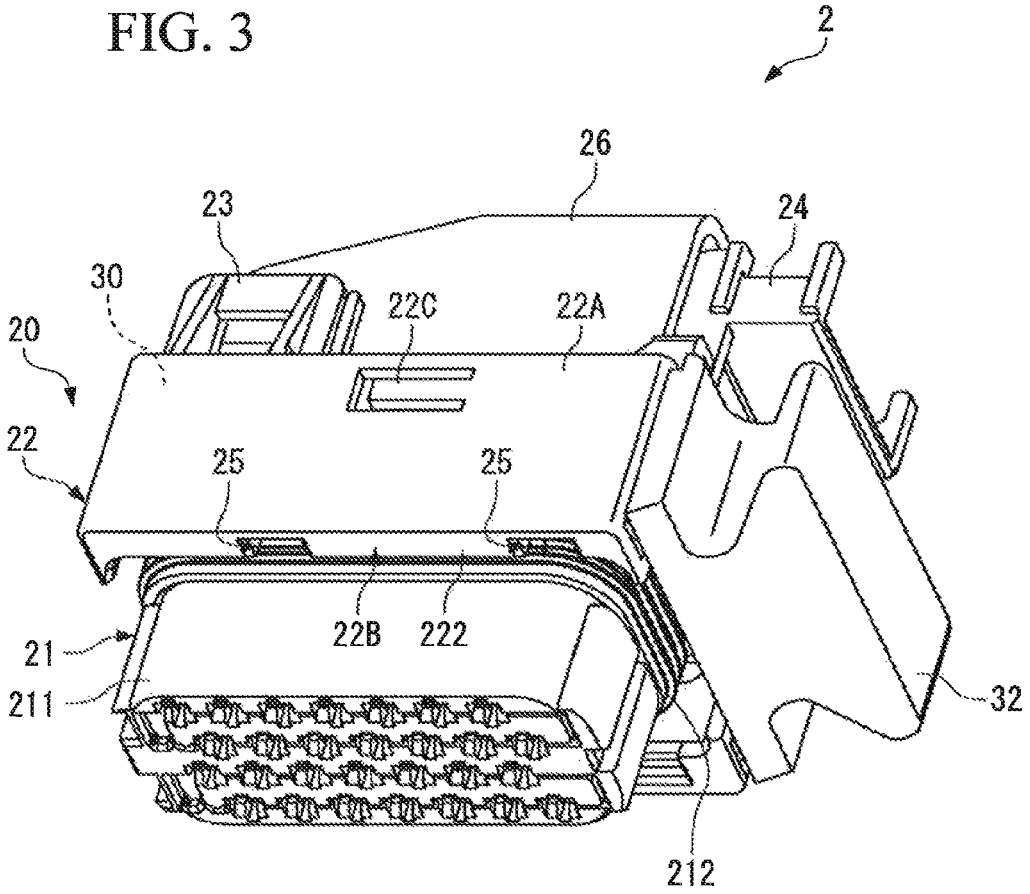
FIG. 3 is a perspective view of a female connector to which a slide is engageable.

As shown in FIGS. 1 to 3, a male connector 1 having a male contact 1A is mated with a female connector 2. The female connector 2 has a slide 3 and female contacts 2A.

The male connector 1 has a first mating face that corresponds to a second mating face on the female connector 2, and a first terminal face, opposite the first mating face. The female connector 2 and the male connector 1 are matable with each other along a mating direction M.

The female connector 2 includes a plurality of female contacts 2A (FIG. 4B) to which electric wires, not shown, are connected, a female housing 20 and a wire cover 26. The female housing 20 holds the female contacts 2A and the slide 3 is assembled to the female housing 20. The wire cover 26 is disposed on a second terminal face of the female housing 20, opposite the second mating face.

The female housing 20 can be manufactured by injection molding an insulating resin, although one of ordinary skill in the art would recognize that other insulating materials could also be used. The female housing 20 includes a holding block 21 for holding the female contacts 2A and the electric wires, a pair of slide assemblies 22 provided on both sides of the holding block 21, cover locking protrusions 23 for locking the wire cover 26, and a wire guide 24 for arranging the electric wires extending out of the wire cover 26.

The holding block 21 has a female mating projection 211 engageable with a corresponding male housing 10 of the male connector 1, and a seal ring 212 disposed on an outer peripheral portion of the female mating projection 211 adjacent to the second mating face. The seal ring 212 is disposed between the female housing 20 and the male housing 10 when the female housing 20 and the male housing 10 are engaged.

The slide 3 is assembled inside a pair of slide assemblies 22, each slide assembly 22 having a rectangular outer surface wall 22A that covers the slide 3, and rails 22B that are formed along the second mating face and a terminal face of the outer surface wall 22A to guide the slide 3.

Figure 6B:
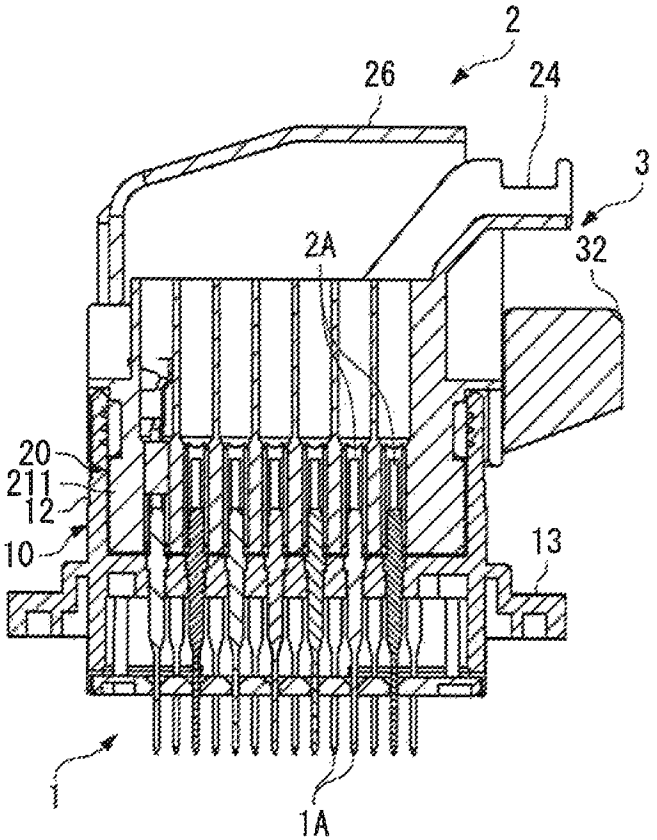
FIGS. 6A and 6B are vertical sectional views showing a state in which engagement has been completed in the axial mating direction.
Figure 6A:
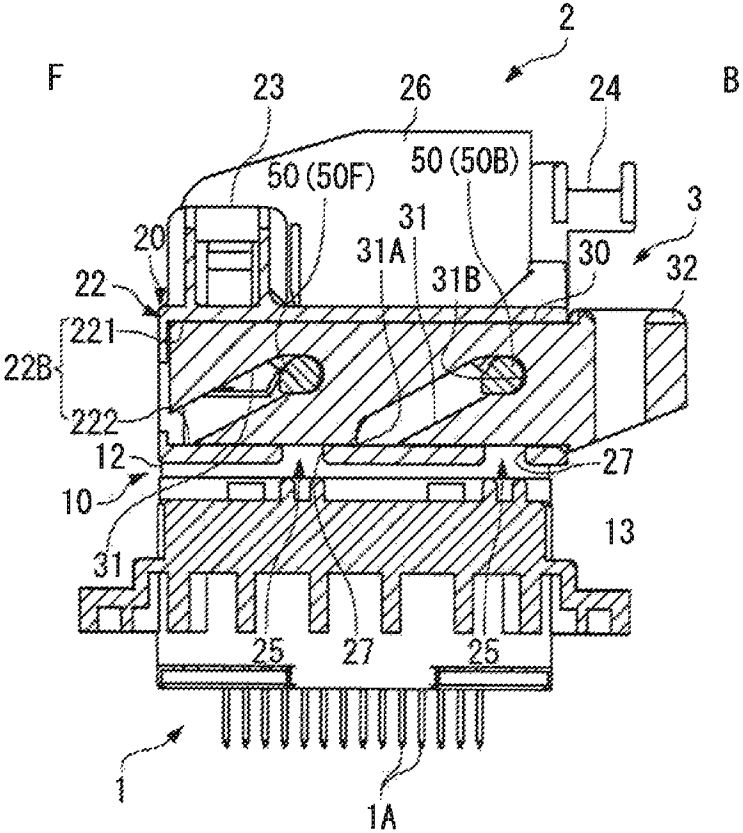

The outer surface wall 22A has a locking mechanism 22C that engages a corresponding locking mechanism of the slide 3 when the slide 3 is at a start position (FIGS. 4A, 4B) and when it is at an end position (FIGS. 6A, 6B).

The rails 22B project inward at a right angle from the outer surface wall 22A, each rail 22B having a first rail 221 extending along a terminal side of the outer surface wall 22A and a second rail 222 extending along the mating face edge of the outer surface wall 22A. (FIG. 4A) The rails 22B may be shifted from the direction intersecting at right angles with the mating direction M.

The second rail 222 is cut in intermediate portions in the longitudinal direction, where cam pin receiving openings 25 that communicate with cam grooves 31 (FIG. 4A) in the slide 3 when the slide 3 is at the start position are formed. The cam pin receiving openings 25 are disposed along the second rail 222, and have an opening width W1. Through the cam pin receiving openings 25, a cam pin 50, described later, of the male connector 1 is introduced into the cam groove 31.

The slide 3 has a pair of side walls 30 extending from a connecting handle 32 to form a U-shaped design. The connecting handle 32 is located on a terminal end 31B (FIGS. 4A, 4B) side of the cam groove 31. Each of the side walls 30 incorporates the cam grooves 31, which are disposed on the side walls 30 and extend in a direction from the mating face towards the terminal face of the female connector 2. The slide 3 is operated so as to move orthogonal to the mating direction M when the male connector 1 and the female connector 2 are engaged with each other or disengaged from each other.

Figure 4B:
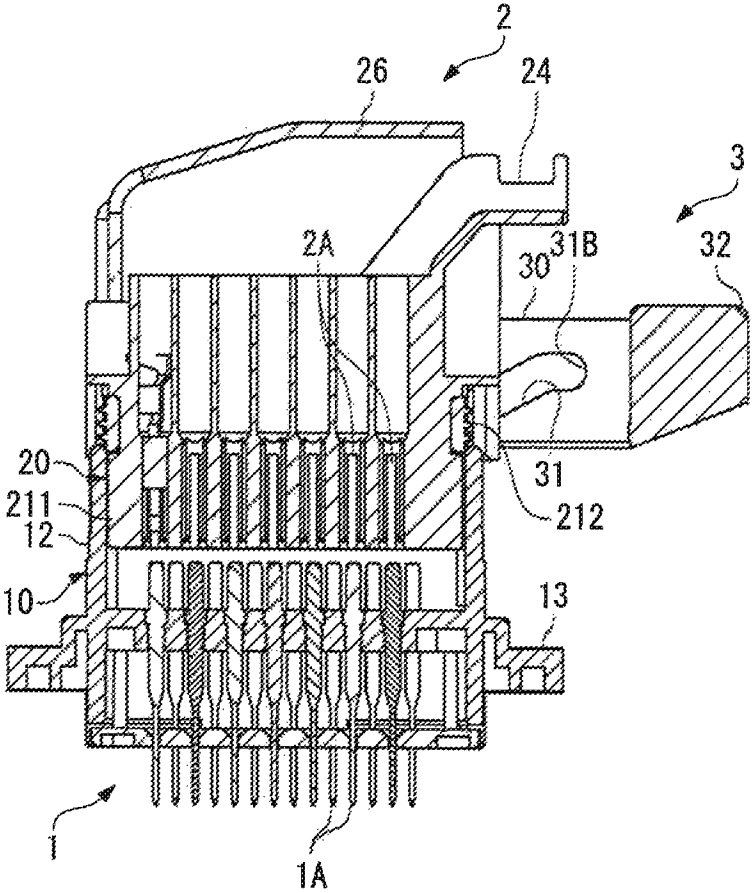
FIGS. 4A and 4B are vertical sectional views of a slide connector in a state in which a cam pin is introduced into an cam pin insertion passageway of a cam groove in the axial mating direction.
Figure 4A:
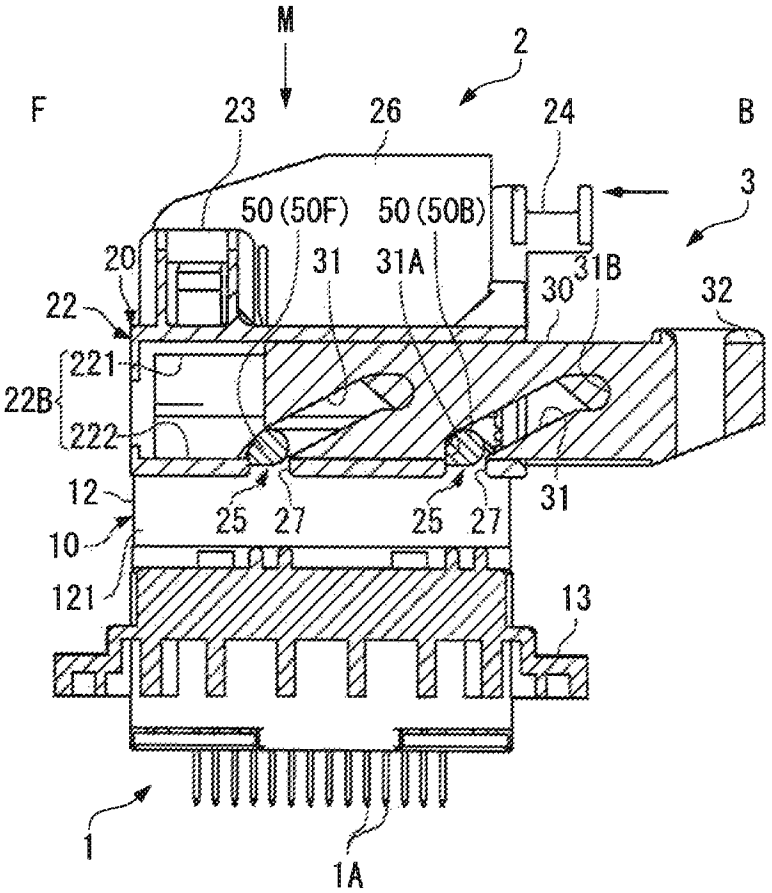

As shown in FIGS. 4A, 4B, the side wall 30 is accommodated between the first rail 221 and the second rail 222.

The cam groove 31 is angularly relative to the operation direction of the slide 3. When the slide 3 is operated along the operation direction thereof, the cam pin 50, described later, of the male connector 1 moves in the cam groove 31 along a direction having components of the mating direction M and the operation direction. As a result, the female connector 2 engages the male connector 1 along the mating direction M. In an embodiment, two complementary cam grooves 31 are formed in each side wall 30 of the female connector 2 and correspond to an equal number of complementary cam pins 50 disposed on the male connector 1. In another embodiment, three complementary cam grooves 31 are formed in each side wall 30 of the female connector 2 and correspond to an equal number of complementary cam pins 50 disposed on the male connector 1. As shown in FIGS. 1 and 4A,4B, the male connector 1 comprises the male contacts 1A, and the male housing 10 for housing the male contacts 1A.

In an embodiment, the male contact 1A is formed as a pin and a tab. However, one of ordinary skill in the art would appreciate that other equivalent contact shapes could also be used. A plurality of male contacts 1A are provided on the inside of the male housing 10, and are received by the female contacts 2A. The terminal end of the male contact 1A projects from the terminal end of the male connector 1 (FIGS. 4A, 4B), and is connected to a printed circuit board (not shown).

In an embodiment, the male housing 10 is manufactured using an insulating resin injection-molded product, however, one of ordinary skill in the art would appreciate that other equivalent insulating materials can also be used.

The male housing 10 includes a contact holder 11 for holding the male contacts 1A, a male mating projection 12 which rises from the mating face of the male connector around a peripheral edge of the contact holder 11 and in which the female mating projection 211 is inserted, and a base 13 fastenable to the printed circuit board (not shown).

The male mating projection 12 has a substantially rectangular opening, and a pair of side walls 121 and 122 extending lengthwise across the mating face of the male connector 1, that is, in the operation direction of the slide 3. In one embodiment, on each of the side walls 121 and 122, a pair of coplanar cam pins 50 are disposed, and project away from an outer surface of the side walls 121 and 122 at an interval corresponding to the cam pin receiving openings 25 of the second rail 222. The cam pins 50, together with the cam grooves 31, form an actuating mechanism for both of the connectors 1 and 2. The paired cam pins 50 consist of a first cam pin 50F and a second cam pin 50B. In an embodiment, the paired first cam pin 50F and second cam pin 50B are formed so as to have the same shape and size.

Figure 5A:
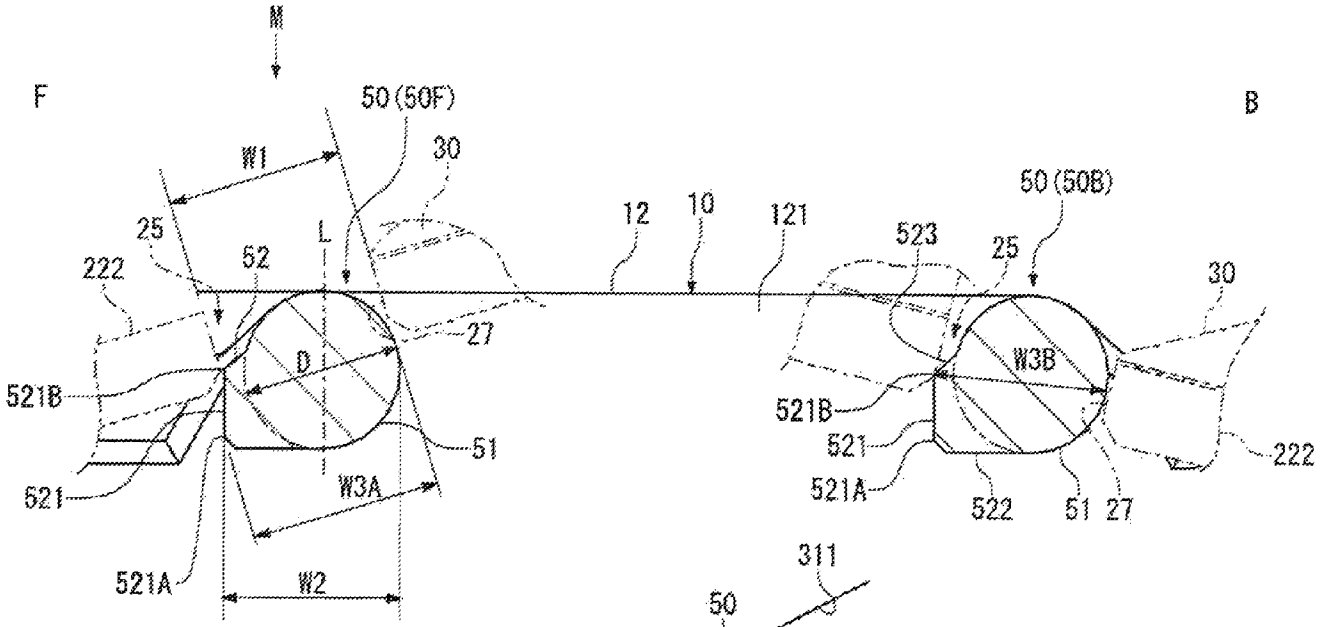
FIG. 5A is an enlarged view showing the side surface of a male housing on which cam pins are formed, showing the transverse cross sections of the cam pins.

As shown in FIG. 5A, each of the first cam pin 50F and second cam pin 50B have a cylindrical pin body 51, and a cam projection 52 formed integrally with the pin body 51. As explained below, the cam pin 50 is configured so as to be introduced into the cam pin receiving openings 25 if the male connector 1 and the female connector 2 are aligned in the axial mating direction, and to be not introduced into the cam pin receiving openings 25 if the connector tilts from the axial mating direction.

It would be understood by one of ordinary skill in the art that all of the cam pins 50 (50F, 50B) formed on the side walls 121 and 122 be provided with the cam projection 52, or only one of the pairs of cam pins 50F or 50B may be provided with the cam projection 52. Only one pair of camp pins 50F, 50B are provided with the cam projection 52 when the tilted female connector 2 will not result in damage to the contacts 1A of the male connector 1.

The pin body 51 is formed such that the diameter D is smaller than the width W1 of the cam pin receiving openings 25. In an embodiment, the shape of the pin body 51 is generally cylindrical. However, in other embodiments the shape of the pin body 51 is an ellipse, or may be formed with vertical grooves on the outer periphery thereof.

Figure 5B:
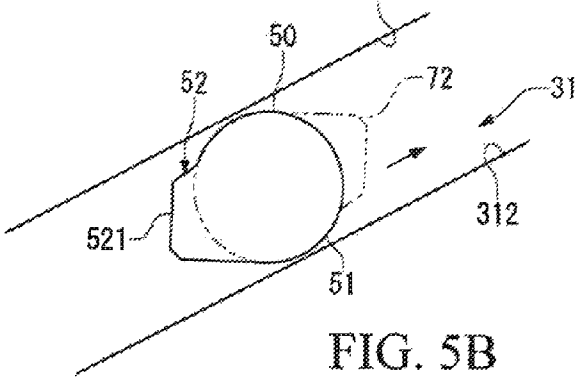
FIG. 5B is a schematic view showing a cam groove and the cam pin.

The cam projection 52 projects from an outer periphery of the pin body 51 to the side in which the cam pin 50 advances in the cam groove 31 when the male connector 1 and the female connector 2 are engaged (the arrow-marked direction in FIG. 5B). Since the cam pin 50 advances toward the terminal end 31B of the cam groove 31 during mating, the mating end 31A of the cam groove 31 is located at the cam pin receiving openings 25.

This cam projection 52 takes a substantially trapezoidal shape. In plan view, it has a first edge 521 that extends parallel with the mating direction M. A second edge 522 extends perpendicular to the mating direction M and intersects at a right angle with the first terminal face the first edge 521. A third edge 523 extends obliquely to the mating direction M from an outward facing first mating end of the first edge 521. The intersection of the first edge 521 and the second edge 522 is referred to as a first corner part 521A, and the intersection of the first edge 521 and the third edge 523 is referred to as a second corner 521B. The first corner 521A is more distant from the axis of the pin body 51 than the second corner 521B. The width W2 is defined as a distance from the first edge 521 to a point on the circumference on the opposite side of the pin body 51 with the shaft center being held therebetween (refer to the left-hand side of FIG. 5A). The width W3A is defined as a distance from the first corner 521A to a point on the circumference on the opposite side of the pin body 51.

The width W3B is defined as a distance from the second corner 521B to a point on the circumference on the opposite side of the pin body 51.

Hereunder, the widths W3A and W3B are sometimes referred to as widths of the tilting cam pin 50. These widths W3A and W3B representatively show, using the corners 521A and 521B as references, locations in which the width of the cam pin 50 is expanded so as to be larger than the diameter D of the pin body 51. The form of the cam projection 52, expands the width of the cam pin 50 whereby width W3 is defined to include the widths W3A and W3B.

For the cam pin 50, the width W1 of the cam pin receiving openings 25, the width W2 of the cam pin 50 in the axial mating direction, and the widths W3A and W3B of the tilting cam pin 50 satisfy the following Formula (1): W3A>W3B>W1>W2. Therefore, when the male connector 1 and female connector 2 are urged along the axial mating direction, the cam pin can be introduced into the cam pin receiving openings 25; however, when the female connector 2 tilts away from the axial mating direction, the cam pin 50 cannot be introduced into the cam pin receiving openings 25.

The cam projection 52 is formed so as to be accommodated in the advance/retreat region of the cam pin 50. The "advance/retreat region" described herein is a gap held between a first cam groove wall 311 and a second cam groove wall 312 along the longitudinal direction of the cam groove 31. The first and second cam groove walls 311, 312 define the cam groove 31. When the male connector 1 and the female connector 2 are mated or disengaged from each other, the cam pin 50 advances or retreats in this advance/retreat region. Since the cam projection 52 is formed as described above, when the male connector 1 and the female connector 2 are mated or disengaged from each other, the cam pin 50 can slide smoothly without interference from the first and second cam groove walls 311, 312 of the cam groove 31.

In the following, the procedure for mating the male connector 1 and female connector 2, explained above, is explained with reference to FIGS. 4A, 4B and 6.

The engagement mechanism for mating the male connector 1 and the female connector 2 is as follows. (FIGS. 4A, 4B, and 6) First, as shown in FIG. 4A, the slide 3 is partially removed from between the slide assemblies 22 of the female connector 2. When the female mating projection 211 is inserted into the inside of the male mating projection 12 in the axial mating direction, the cam pins 50 of the male connector 1 are introduced along the mating direction M into the corresponding cam pin receiving openings 25 of the female connector 2 (FIG. 4A).

The diameter D of the cam pin 50 is smaller than the width W1 of the cam pin receiving openings 25, as expressed in Formula (1), the pin body 51 is introduced into the cam pin receiving openings 25 before the cam projection 52, such that the cam pin 50 is guided into the cam pin receiving openings 25 without interference. By the relationship of width W1>width W2 in Formula (1), the cam pin 50 is introduced into the cam pin receiving openings 25 without difficulty, and without interfering with an end edge 27 located at the com pin receiving opening 25. At this time, the first edge 521 is in sliding contact with the end edge 27, so that the cam pin 50 is guided to the inside of the cam pin receiving openings 25. The cam pin 50 having passed through the cam pin receiving openings 25 is arranged at the start end 31A in the cam groove 31.

When an attempt is made to engage the male connector 1 and the female connector 2 with each other in the axial mating direction as described above, in the state in which the cam pin 50 has been inserted into the cam groove 31, the female mating projection 211 is prevented from contacting the male contacts 1A, so that the male contacts 1A are not damaged.

Next, when the slide 3 is inserted into the female connector 2 (the arrow-marked direction in FIG. 4A), the cam pin 50 advances toward the terminal end 31B of the cam groove 31, the female connector 2 engages the male connector 1 along the mating direction M.

Since the cam projection 52 is formed so as to be accommodated in the advance/retreat region as described above, the cam pin 50 slides smoothly in the cam groove 31 without the interference of the cam projection 52 with the cam groove walls 311, 312 of the cam groove 31. When the cam pin 50 arrives at the terminal end 31B of the cam groove 31 as shown in FIG. 6A, mating of the female connector 2 with the male connector 1 is completed.

In order to disengage the female connector 2 from the male connector 1, the slide 3 is operated in the direction reverse to the direction of the above-described mating operation. As the cam pin 50 is guided from the terminal end 31B to the start end 31A of the cam groove 31, the female connector 2 is released from the male connector 1. The sliding operation can be performed smoothly without the interference of the cam projection 52 with the inner walls of the cam groove 31. When the cam pin 50 arrives at the start end 31A of the cam groove 31 as shown in FIG. 4A, the female connector 2 is released from the male connector 1.

At this time, since the difference between the width W1 of the cam pin receiving openings 25 and the width W2 at the time of axial mating direction is slight, when the first edge 521 of the cam pin 50 is in contact with the end edge 27 of the cam pin receiving openings 25, the female connector 2 is held by the male connector 1. Thereby, the male connector 1 and the female connector 2 are not instantly separated from each other, and are kept in a temporarily locked state. The force necessary for temporary locking can be adjusted by varying the width W1 and/or width W2 and the lengths of the first edge 521 and the end edge 27. Conversely, by adjusting these factors, the temporary locking can also be minimized.

When the female connector 2 is separated from the male connector 1 along the mating direction M, the temporary locking is released. At this time, the cam pin 50 is removed from of the cam pin receiving openings 25 by the first edge 521.

Figure 7B:
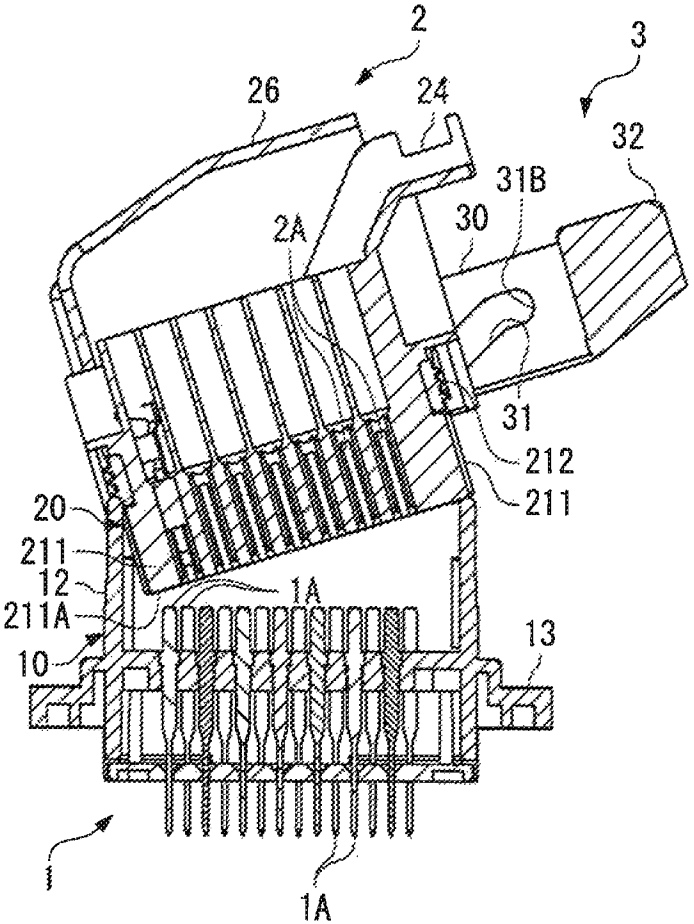
FIGS. 7A and 7B are vertical sectional views showing a state in which a mating connector tilts along the direction in which a cam groove extends.
Figure 7A:
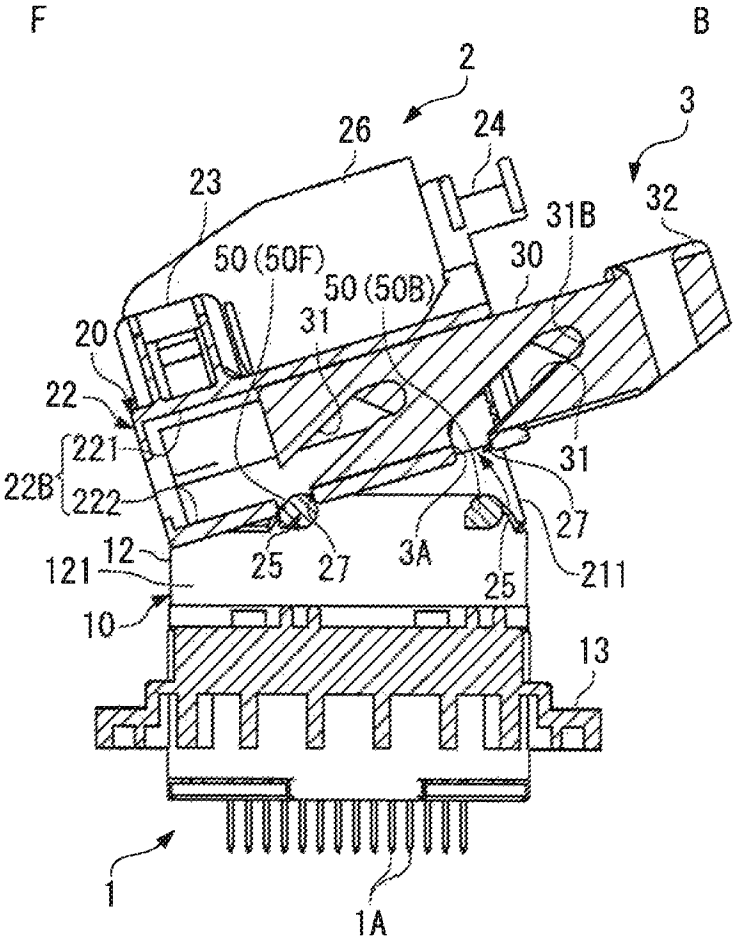
Figure 8B:
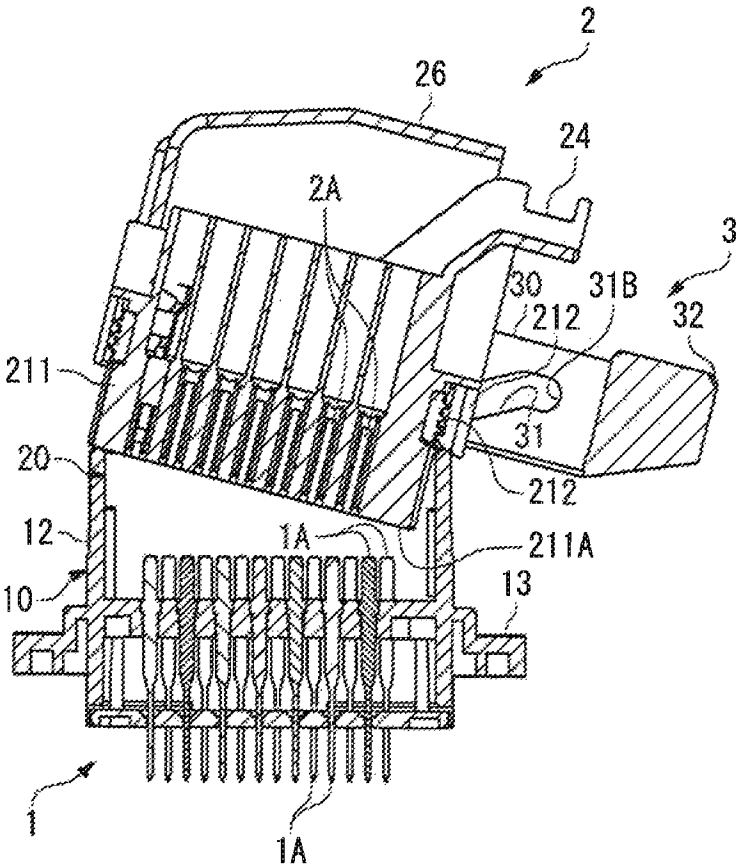
FIGS. 8A and 8B are vertical sectional views showing a state in which a mating connector tilts to the side opposite to the direction shown in FIGS. 7A and 7B.
Figure 8A:
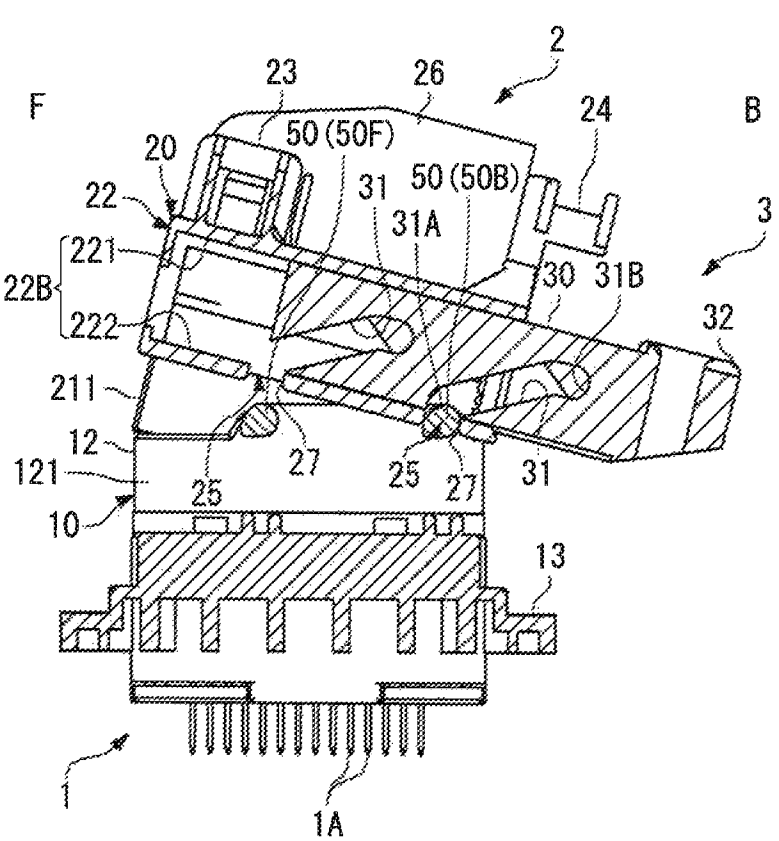
Figure 9B:
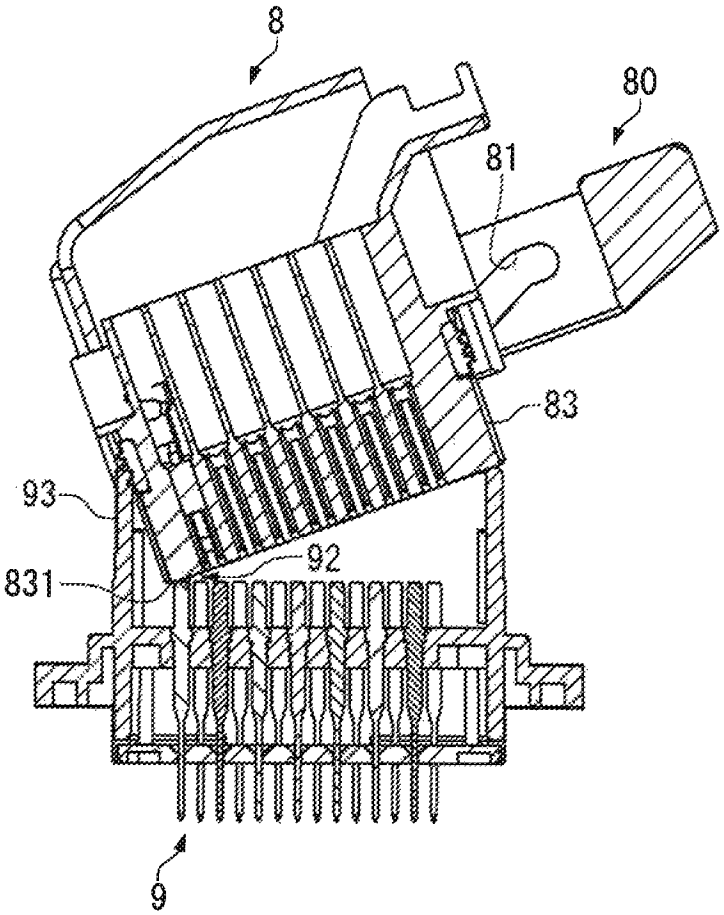
FIGS. 9A and 9B are vertical sectional views showing an example in which contact damage occurs where conventional cam pins having a circular cross section are used.
Figure 9A:
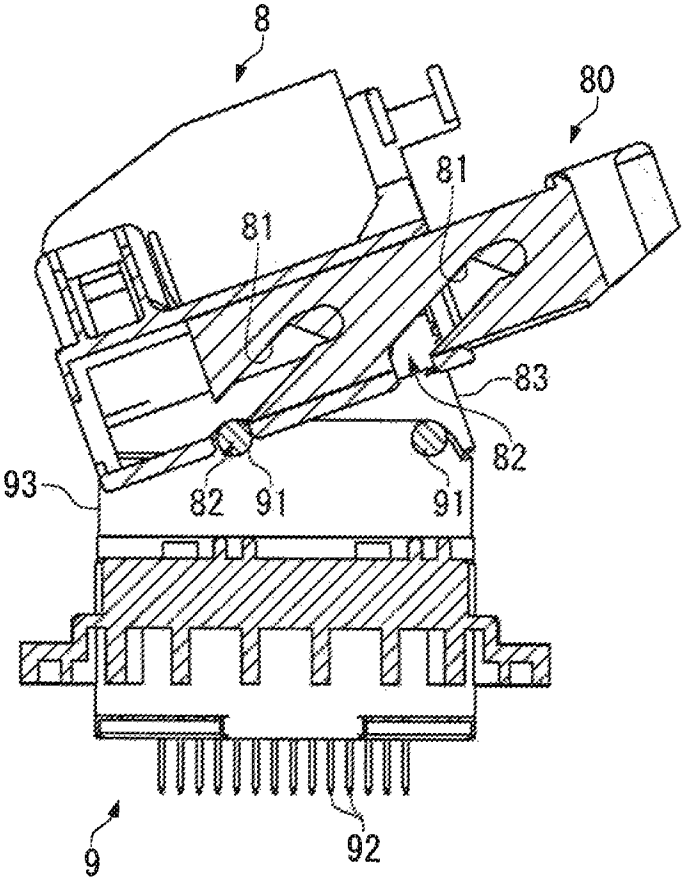
Figure 10C:
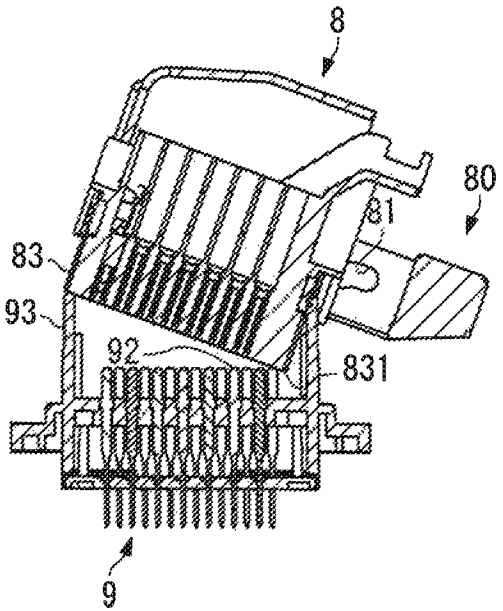
FIGS. 10A, 10B and 10C are vertical sectional views showing an example in which contact damage occurs where conventional cam pins each having a circular cross section are used.
Figure 10B:
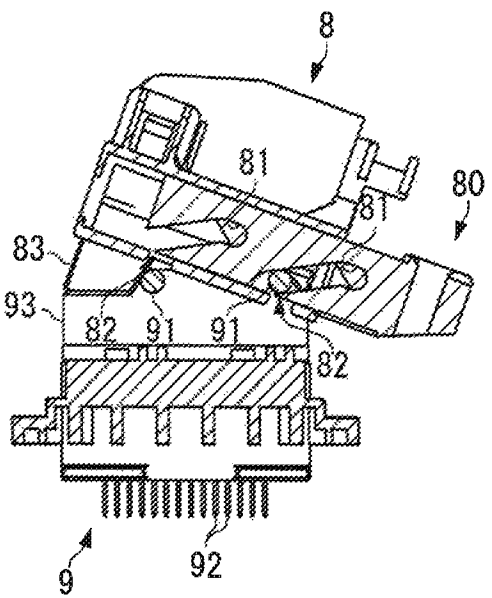
Figure 10A:
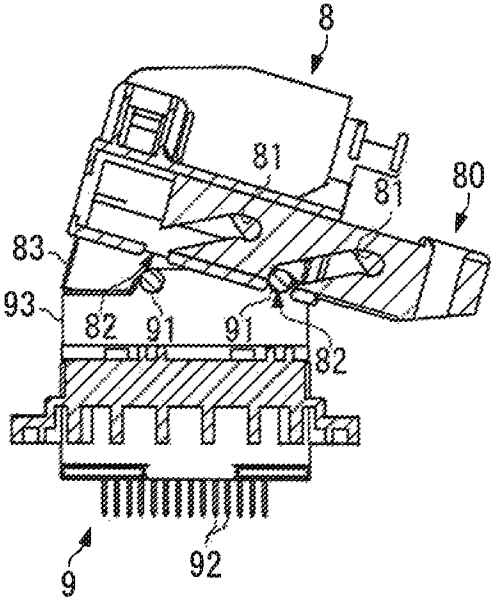

Since the cam pins 50F and 50B are offset along the pair of side walls 121 and 122 extending lengthwise across the mating face of the male connector 1, damage to the male contacts 1A can more easily occur if the female connector 2 tilts counterclockwise as shown in FIGS. 7A, 7B than when the female connector 2 tilts clockwise as shown in FIGS. 8A, 8B.

Since the width W3A of the tilting first cam pin 50F is larger than the width W1 of the cam pin receiving openings 25, the first cam pin 50F interferes with the end edge 27 of the cam pin receiving openings 25, such that the first cam pin 50F is prevented from entering the cam pin receiving openings 25. As a result, the female connector 2 is prevented from engaging with the male connector 1, and the contact of the female mating projection 211 with the male contact 1A is prevented.

When a female connector 2 tilts clockwise with respect to the male connector 1, as shown in FIGS. 8A, 8B, as shown on the right-hand side of FIG. 5A, the width W3B of the first cam pin 50F is larger than the width W1 of the cam pin receiving openings 25. The second corner 521B of the second cam pin 50B interferes with the end edge 27 of the cam pin receiving openings 25, and prevents the second cam pin 50B from entering the cam pin receiving opening 25. Therefore, when female connector 2 tilts clockwise, the male contacts 1A cannot engage the female connector 2 and damage to the contacts 1A is prevented.

Additionally, the cam projection 52 has only to be added to the pin body 51 of the male connector 1 without a change of the female connector 2. Therefore, the female connector 2 having been used so far can be used continuously as it is.

Furthermore, the need for guide ribs is eliminated, since it is unnecessary to increase the size of the male connector 1 and the female connector 2.

One of ordinary skill in the art would appreciate that cam projection 52 of the cam pin 50 can be other shapes, as long as the cam projection 52 can accomplish the above-described function. For example, the shape of the cam projection 52 may be a triangular shape whose vertex is the first corner 521A, or may be a rectangular shape whose long side is the first edge 521.

In another embodiment, the length of the first edge 521 engaging with the end edge 27 of the cam pin receiving openings 25 is increased or decreased to control the amount of interaction the first edge 521 engages with the cam groove walls 311, 312 of the cam groove 31, such that the cam pin 50 can be introduced into the cam pin receiving openings 25 with more resistance when the length of the first edge 521 is increased, or less resistance when the length of the first edge 521 is decreased.

In another embodiment, as shown in FIG. 5B, a second cam projection 72 projecting to the opposite side of the cam projection 52 may be formed. The second cam projection 72 is formed on the terminal end 31B facing side of the cam groove 31 so as to be symmetrical with the axis of the pin body 51 being held between the second cam projection 72 and the above-described cam projection 52.

In this embodiment, the second cam projection 72 permits the same operation and effect as the embodiment were only the cam projection 52 is formed can be achieved. The use of both the cam projection 52 and the second cam projection 72 permits additional control of the alignment of the male connector 1 and the female connector 2 during mating. In this embodiment, an enlarged cavity (not shown) is present for accommodating the second cam projection 72 at the terminal end 31B of the cam groove 31.

Although several embodiments have been shown and described, it would be appreciated by those of ordinary skill in the art that various changes or modifications may be made in these embodiments without departing from the principles and spirit of the disclosure, the scope of which is defined in the claims and their equivalents.

What is claimed is:

1. A connector comprising:

a housing with a mating face;

a slide assembly having a cam pin receiving opening on the mating face with a width W1 measured along the mating face;

a slide having a cam groove in communication with the cam pin receiving opening; and a cam pin on a mating housing engageable with the cam pin receiving opening, having a width W2 measured along the mating face being less than the width W1, and a width W3 measured at an angle to the mating face being greater than the width W1.

2. The connector according to claim 1, wherein the cam pin further comprises:

a pin body having a cylindrical shape; and a cam projection formed on an outer periphery of the pin body.

3. The connector according to claim 2, wherein the cam projection is formed integrally with the pin body.

4. The connector according to claim 2, wherein the cam projection is formed on a side opposite to the direction in which the cam pin advances in the cam groove when the slide is engagingly operated.

5. The connector according to claim 1, wherein the cam pin has a first edge parallel with a mating direction.

6. The connector according to claim 1, wherein the cam pin is disposed on a male connector having male contacts; and the mating connector is a female connector having female contacts which are engageable with the male contacts.

7. The connector according to claim 1, further comprising:

a plurality of cam pins;

a plurality of corresponding cam grooves formed in the slide; and at least one of the plurality of cam pins formed such that the width W3 is larger than the width W1.

8. A connector comprising:

a cam pin receiving opening disposed along a mating face of a first mating connector and being in communication with a cam groove formed in a slide of the first mating connector, the cam pin receiving opening having a width W1 measured orthogonally to a mating direction;

a cam pin insertable into the cam groove, the cam pin having:

a width W2 measured orthogonally to the mating direction and being less than the width W1, and a width W3 measured at an angle to the mating direction and being greater than the width W1;

the slide being engagingly operated from a start position to an end position, such that the cam pin advances in the cam groove relative to the cam groove; and the first mating connector being engageable with the second mating connector along the mating direction intersecting at right angles with the direction in which the slide is operated.

9. The connector according to claim 8, wherein the cam pin further comprises:

a pin body having a cylindrical shape; and a cam projection formed on an outer periphery of the pin body.

10. The connector according to claim 9, wherein the cam projection is formed integrally with the pin body.

11. The connector according to claim 9, wherein the cam projection is formed on a side opposite to the direction in which the cam pin advances in the cam groove when the slide is engagingly operated.

12. The connector according to claim 8, wherein the cam pin has a first edge parallel with the mating direction.

13. The connector according to claim 8, wherein the first mating connector is a female connector having female contacts; and the second mating connector is a male connector having male contacts which are engageable with the female contacts.

14. The connector according to claim 8, further comprising:

a plurality of cam pins;

a plurality of corresponding cam grooves formed in the slide; and at least one of the plurality of cam pins formed such that the width W3 is larger than the width W1.

* * * * *